US009865246B2

(12) United States Patent
Kang et al.

(10) Patent No.: US 9,865,246 B2
(45) Date of Patent: Jan. 9, 2018

(54) LASER-INDUCED ULTRASOUND GENERATOR AND METHOD OF MANUFACTURING THE SAME

(71) Applicants: SAMSUNG ELECTRONICS CO., LTD., Suwon-si (KR); Korea Advanced Institute of Science and Technology, Daejeon (KR)

(72) Inventors: Sung-chan Kang, Hwaseong-si (KR); Jong-seok Kim, Hwaseong-si (KR); Chang-jung Kim, Yongin-si (KR); Seung-bum Yang, Daejeon (KR); Young-jae Oh, Daejeon (KR); Yong-seop Yoon, Seoul (KR); Ki-hun Jeong, Daejeon (KR)

(73) Assignees: SAMSUNG ELECTRONICS CO., LTD., Daejeon (KR); Korea Advanced Institute Of Science and Technology, Daejeon (KR)

( * ) Notice: Subject to any disclaimer, the term of this patent is extended or adjusted under 35 U.S.C. 154(b) by 429 days.

(21) Appl. No.: 14/296,567

(22) Filed: Jun. 5, 2014

(65) Prior Publication Data

US 2015/0131408 A1 May 14, 2015

(30) Foreign Application Priority Data

Nov. 11, 2013 (KR) ..... 10-2013-0136302

(51) Int. Cl.

| | |
|---|---|
| ***C23F 1/00*** | (2006.01) |
| ***G10K 15/04*** | (2006.01) |
| ***B06B 1/00*** | (2006.01) |

(52) U.S. Cl.

CPC ..... *G10K 15/046* (2013.01); *B06B 1/00* (2013.01)

(58) Field of Classification Search

USPC ..... 367/140

See application file for complete search history.

(56) References Cited

U.S. PATENT DOCUMENTS 7,500,953 B2 3/2009 Oraevsky et al.
7,917,966 B2 * 3/2011 Kim ..... B82Y 15/00 850/52

(Continued)

FOREIGN PATENT DOCUMENTS

KR 10-1011108 B1 1/2011
KR 10-1205392 B1 11/2012

(Continued)

OTHER PUBLICATIONS

O'Donnell; Optoacoustic generation of high frequency sound for 3-D ;ultrasonic imaging in medicine; Dec. 15, 2009.*

(Continued)

*Primary Examiner* — Luke D Ratcliffe
*Assistant Examiner* — Amie M Ndure
(74) *Attorney, Agent, or Firm* — Sughrue Mion, PLLC

(57) ABSTRACT

Provided are a laser-induced ultrasound generator and a method of manufacturing the laser-induced ultrasound generator. The laser-induced ultrasound generator includes: a substrate including a plurality of nanostructures provided on a first surface of the substrate; and a thermoelastic layer provided on the first surface of the substrate, the thermoelastic layer being configured to generate an ultrasound by absorbing a laser beam incident onto a second surface of the substrate, the second surface facing the first surface. The nanostructures may be cylinder-shaped nano-pillars.

15 Claims, 6 Drawing Sheets

(56) References Cited

U.S. PATENT DOCUMENTS 7,959,441 B2 6/2011 Glover et al.
8,070,929 B2 * 12/2011 Kim ..... B01J 23/28 205/118
8,193,499 B2 6/2012 Nagao et al.
8,276,106 B2 * 9/2012 Cases ..... G06F 17/5045 703/13
8,569,900 B2 * 10/2013 Quitoriano ..... B81B 1/00 257/798
8,629,770 B2 * 1/2014 Hummer ..... G08B 21/12 340/531
8,859,423 B2 * 10/2014 Thomas ..... H01L 31/02246 257/E31.124
8,975,670 B2 * 3/2015 Or-Bach ..... H01L 23/552 257/272
9,385,058 B1 * 7/2016 Or-Bach ..... H01L 25/0657
2009/0087582 A1 * 4/2009 Watanabe ..... B81C 1/00031 427/558
2009/0173931 A1 * 7/2009 Stumbo ..... B81C 99/008 257/14
2010/0055620 A1 * 3/2010 Kwon ..... B82B 3/00 430/323
2012/0209116 A1 * 8/2012 Hossack ..... A61B 8/12 600/439
2012/0306082 A1 * 12/2012 Sekar ..... H01L 23/3677 257/758
2012/0313227 A1 * 12/2012 Or-Bach ..... H01L 23/552 257/659
2013/0190595 A1 * 7/2013 Oraevsky ..... A61B 5/0095 600/407

FOREIGN PATENT DOCUMENTS

KR 10-1223762 B1 1/2013
KR 10-1241332 B1 3/2013

OTHER PUBLICATIONS

Atwater, Harry A. et al., "Plasmonics for Improved Photovoltaic Devices," Nature Materials, vol. 9, Feb. 19, 2010, pp. 205 to 213.
Hou, Yang et al., "Optical Generation of High Frequency Ultrasound Using Two-Dimensional Gold Nanostructure," Applied Physics Letters, vol. 89, Aug. 31, 2006, pp. 093901-1 to 093901-3.

* cited by examiner

LASER-INDUCED ULTRASOUND GENERATOR AND METHOD OF MANUFACTURING THE SAME

CROSS-REFERENCE TO RELATED APPLICATION

This application claims priority to Korean Patent Application No. 10-2013-0136302, filed on Nov. 11, 2013, in the Korean Intellectual Property Office, the disclosure of which is incorporated herein in its entirety by reference.

BACKGROUND

1. Field

The exemplary embodiments relate to laser-induced ultrasound generators and methods of manufacturing the same.

2. Description of the Related Art

When a laser is irradiated onto a material such as a liquid or a solid, the irradiated material absorbs light energy to generate instant thermal energy, and the thermal energy generates an acoustic wave due to thermoelasticity of the material.

As an absorption ratio and a thermoelastic coefficient of materials vary according to a light wavelength of the materials, ultrasound waves generated by different materials differ in amplitude in response to the same light energy. The generated ultrasound waves are used in an analyzer of materials, a non-destructive tester, and a photoacoustic tomography, or the like.

A laser-induced ultrasound generator (hereinafter referred to as an ultrasound generator) is an apparatus for generating an ultrasound wave by using a laser. By using the ultrasound wave, it may be diagnosed as to whether, for example, tumors are formed in the body of a patient, that is, in an object. The ultrasound wave is generated based on the principle that energy of absorbed light is converted into pressure.

A conventional laser-induced ultrasound generator uses a thermoelastic material layer having a low light absorption ratio, and thus, a low ultrasound generation efficiency.

SUMMARY

Provided are laser-induced ultrasound generators with an increased ultrasound generation efficiency.

Provided are methods of manufacturing the laser-induced ultrasound generators.

Additional aspects will be set forth in part in the description which follows and, in part, will be apparent from the description, or may be learned by practice of the presented exemplary embodiments.

According to an aspect of an exemplary embodiment, there is provided a laser-induced ultrasound generator including: a substrate including a plurality of nanostructures provided on a first surface of the substrate; and a thermoelastic layer provided on the first surface of the substrate, the thermoelastic layer being configured to generate an ultrasound by absorbing a laser beam incident onto a second surface of the substrate, the second surface facing the first surface.

The plurality of nanostructures may include a plurality of cylinder-shaped nanopillars.

Each of the plurality of nanopillars may have a diameter of about 10 nm to about 1000 nm.

A gap between adjacent nanopillars may be about 10 nm to about 1000 nm.

The thermoelastic layer may include a metal or a polymer material.

The substrate may include a laser beam-transmitting material.

The laser-induced ultrasound generator may further include a matching layer provided on the thermoelastic layer, wherein a surface of the matching layer faces the first surface of the substrate.

The matching layer may include a polymer.

The laser-induced ultrasound generator may further include a laser oscillator configured to irradiate the laser beam onto the second surface of the substrate.

According to another aspect of an exemplary embodiment, there is provided a method of manufacturing a laser-induced ultrasound generator, the method including: forming a thin metal film on a substrate; converting the thin metal film into a plurality of metal dots by annealing the substrate; forming a plurality of nanostructures on the substrate by dry-etching the substrate, the dry-etching comprising using the plurality of metal dots as a mask; removing the plurality of metal dots; and forming a thermoelastic layer on the substrate to cover the plurality of nanostructures.

The forming of the thin metal film may include forming a thin metal film having a thickness of about 10 nm to about 1000 nm.

The converting of the thin metal film into the plurality of metal dots may include forming metal dots, each having a diameter of about 10 nm to about 1000 nm, as the plurality of metal dots.

The forming of the plurality of nanostructures may include forming a plurality of nanopillars, each having a diameter corresponding to a size of one of the plurality of metal dots, as the plurality of nanostructures.

The method may further include forming a matching layer on the thermoelastic layer, a surface of the matching layer facing a surface of the substrate.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
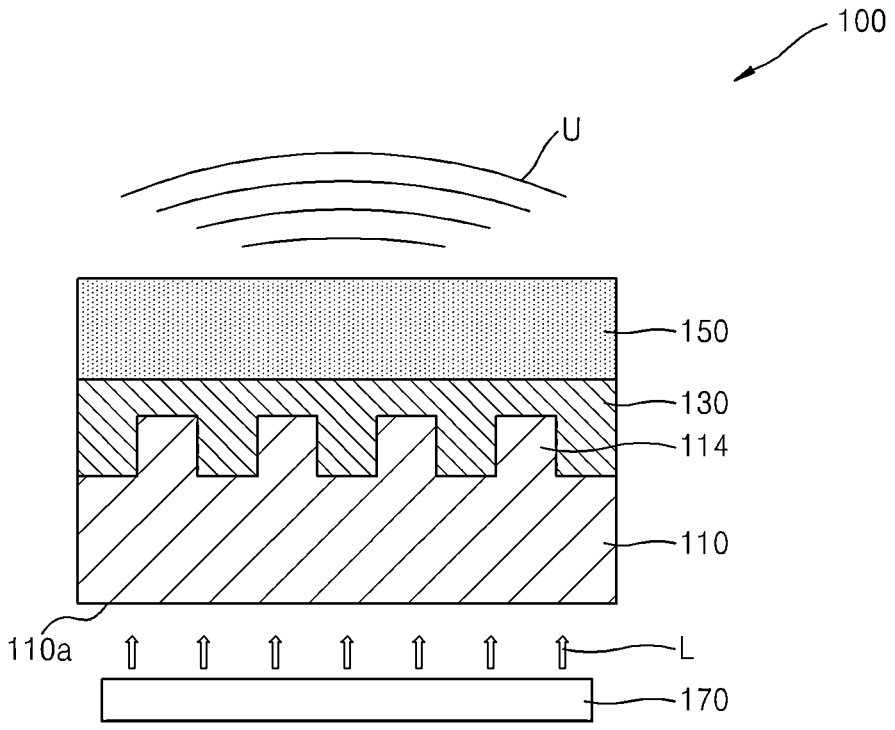
FIG. 1 is a schematic structural view of a ultrasound generator according to exemplary embodiments.

Reference will now be made in detail to exemplary embodiments, examples of which are illustrated in the accompanying drawings, wherein thicknesses of layers or regions illustrated in the drawings are exaggerated for clarity of description. In this regard, the present exemplary embodiments may have different forms and should not be construed as being limited to the descriptions set forth herein. It will be understood that when an element is referred to as being "on" another element, it can be directly on the other element, or intervening elements may also be present. Like reference numerals refer to the like elements throughout and a detailed description thereof will be omitted.

FIG. 1 is a schematic structural view of an ultrasound generator 100 according to exemplary embodiments.

Referring to FIG. 1, the ultrasound generator 100 may include a substrate 110 through which a laser beam L is transmitted, and a thermoelastic layer 130 formed on the substrate 110. A matching layer 150 may be further formed on the thermoelastic layer 130. A laser oscillator 170 irradiates the laser beam L onto the substrate 110.

The substrate 110 may be formed of a material having a relatively high light transmittivity so that a laser beam L may be incident onto the thermoelastic layer 130 without any loss. The substrate 110 may be formed of quartz, fused silicon, glass or the like. The laser beam L may be incident onto a first surface 110*a* of the substrate 110, and a plurality of nanostructures may be formed on a surface of the substrate 110 opposite to the first surface 110*a*. The nanostructures may be cylinder-shaped nanopillars 114. The nanopillars 114 may be formed by etching the substrate 110 and thus, the nanopillars may be formed to be expanded from the substrate 110.

Although the nanopillars 114 are illustrated as the nanostructures according to the current exemplary embodiment, the exemplary embodiments are not limited thereto. For example, nano-cone structures may be formed as the nanostructures instead of the nanopillars 114.

The nanopillars 114 may have a diameter of about 10 nm to about 1000 nm, and a gap between adjacent nanopillars 114 may be about 10 nm to about 1000 nm.

Figure 2:
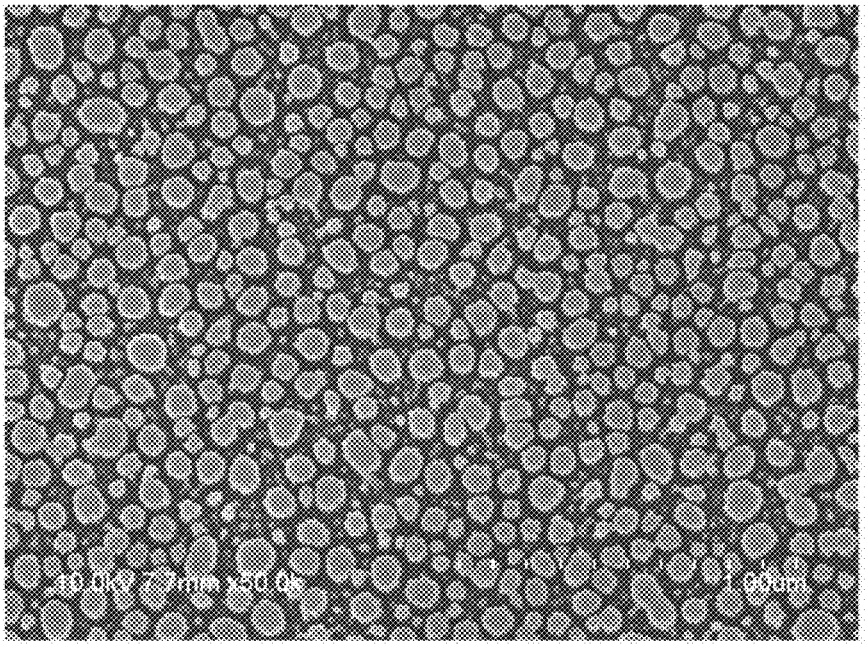
FIG. 2 is a scanning electron microscope (SEM) photographic image of nanopillars formed on a glass substrate.

FIG. 2 is a scanning electron microscope SEM photographic image of the nanopillars 114 formed on the substrate 110 which is formed of glass. Referring to FIG. 2, each of the nanopillars 114 may have an average diameter of about 100 nm, and a gap between adjacent nanopillars 114 may be about 100 nm. As illustrated in FIG. 2, the nanopillars 114 may have different diameters from one another.

The thermoelastic layer 130 expands upon absorbing an irradiated laser beam L, and an ultrasound U is generated according to the expansion of the thermoelastic layer 130. The thermoelastic layer 130 may be formed of a material having a relatively high thermal expansion coefficient. The thermoelastic layer 130 may be a thin film so as to easily thermally expand or contract. For example, the thickness of the thermoelastic layer 130 may be several μm or less. The thermoelastic layer 130 may be formed of a metal or a polymer material. For example, the thermoelastic layer 130 may be formed of a metal such as Cr, Ti, Au, or Al or of a polymer material such as black polydimethylsiloxane (PDMS) mixed with carbon or carbon tapes.

The thermoelastic layer 130 may fill spaces between the nanopillars 114. The thermoelastic layer 130 may completely fill spaces between the nanopillars 114 as illustrated in FIG. 1. However, exemplary embodiments are not limited thereto. For example, the thermoelastic layer 130 having a small thickness may be formed to partially fill spaces between the nanopillars 114.

If the thermoelastic layer 130 is formed of the metal, the thermoelastic layer 130 may be formed as a double layer. For example, the thermoelastic layer 130 may include an adhesive layer formed of Ti or Cr and a metal layer including a material such as Au or Al on the adhesive layer.

The matching layer 150 may modify acoustic impedance of an ultrasound U generated in the thermoelastic layer 130 stepwise so that the acoustic impedance of the ultrasound U is similar to that of an object. The thermoelastic layer 130 may be a single layer or may be formed of a plurality of layers. The matching layer 150 may be formed of a polymer material. For example, the matching layer 150 may be formed of parylene, polydimethylsiloxane (PMDS) or polyimide.

The matching layer 150 on the thermoelastic layer 130 may be omitted. In particular, if the thermoelastic layer 130 is formed of a polymer material, the matching layer 150 may be omitted.

The laser oscillator 170 irradiates the laser beam L onto the substrate 110, from which an ultrasound U is generated. For example, the laser oscillator 170 may be a pulse laser, and a pulse width of the laser may be in the range of nanoseconds or picoseconds.

After the laser beam L is transmitted through the substrate 110 and then is irradiated onto the thermoelastic layer 130, an ultrasound U is generated in the thermoelastic layer 130 due to thermoelasticity. The ultrasound U is irradiated onto an object, a portion of the ultrasound U is absorbed by the object, and the remainder of the ultrasound U is reflected. By receiving a signal reflected by the object, that is, an echo signal of the ultrasound U, a shape of the object and characteristics of tissues of the object may be measured.

The ultrasound generator 110 may convert light into the ultrasound U based on the following principle. When light having an energy density of I(x, y, z, t) is irradiated onto the thermoelastic layer 130, the thermoelastic layer 130 generates heat H as expressed as in Equation 1 below.

$$H=(1-R)\cdot I\cdot\mu e^{\mu z} \quad \text{([Equation 1]}$$

Here, R denotes a reflection coefficient of a thermoelastic layer with respect to the light, and μ denotes an absorption coefficient of the thermoelastic layer with respect to the laser beam, and z denotes a vertical distance between the thermoelastic layer and a surface onto which the laser beam is incident.

In the thermoelastic layer, a variation in temperature (ΔT) as expressed in Equation 2 below is generated.

$$\frac{k}{C^2}\frac{\partial^2 T}{\partial t^2}+\rho C_P\frac{\partial T}{\partial t}=\nabla(k\cdot\nabla T)+H \quad \text{[Equation 2]}$$

Here, k denotes a thermal conductivity of the thermoelastic layer, C denotes a heat propagation speed in the thermoelastic layer, ρ denotes a density of the thermoelastic layer, and Cp denotes a specific heat of the thermoelastic layer.

Due to the variation in temperature (ΔT), a variation in volume (ΔV) as in Equation 3 below is generated in the thermoelastic layer.

$$\frac{\partial^2}{\partial t^2}\left(\frac{dV}{V}\right)=\beta\frac{\partial^2 T}{\partial t^2} \quad \text{[Equation 3]}$$

Here, β denotes a thermal coefficient of volume of the thermoelastic layer.

An ultrasound having a pressure P as expressed in Equation 4 below is generated according to the variation in volume (ΔV) of the thermoelastic layer.

$$\frac{1}{\rho}\left(\nabla^2 - \frac{1}{v_S^2}\frac{\partial^2}{\partial t^2}\right)P = -\frac{\partial^2}{\partial t^2}\left(\frac{dV}{V}\right) \quad \text{[Equation 4]}$$

Here, $v_s$ denotes a speed at which the ultrasound travels.

If the same material is used for the thermoelastic layer in the ultrasound generator, an ultrasound generation efficiency may be improved only by increasing the light absorption ratio of the thermoelastic layer.

According to exemplary embodiments, the nanopillars 114 are formed between the substrate 110, which is an insulation material, and the thermoelastic layer 130, and thus, light irradiated onto the nanopillars 114 generates surface plasmon polaritons between the substrate 110 and the thermoelastic layer 130. If the nanopillars 114, which are nanostructures in a three-dimensional shape, are formed between the substrate 110 and the thermoelastic layer 130, the surface plasmon polaritons become trapped in the nanostructures, and a light absorption ratio in the thermoelastic layer 130 is increased. Thus, an ultrasound generation efficiency may be improved.

Figure 3:
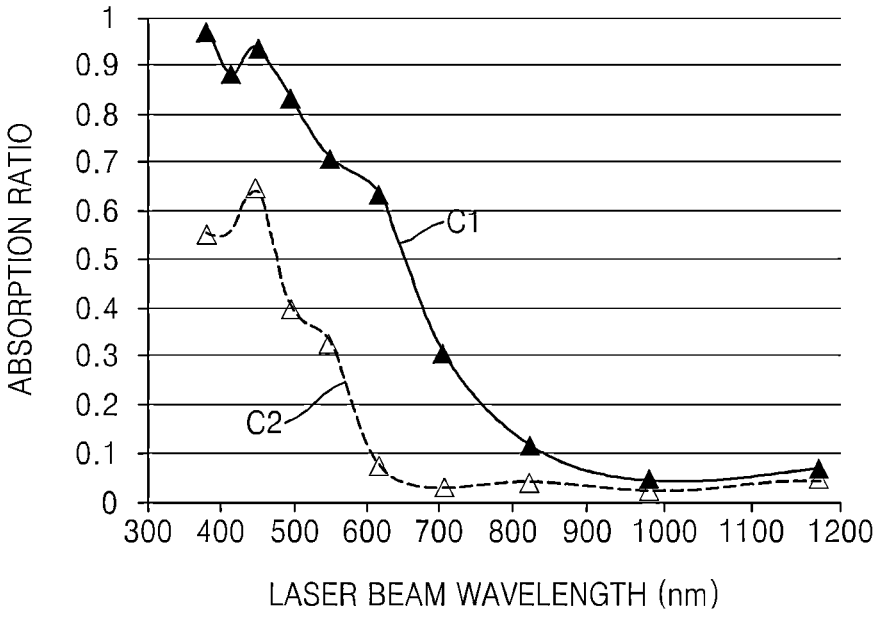
FIG. 3 is a simulation graph showing light absorption ratios of an ultrasound generator having nanostructures according to exemplary embodiments and a conventional ultrasound generator without nanostructures.

FIG. 3 is a simulation graph showing light absorption ratios of an ultrasound generator having nanostructures according to exemplary embodiments and a conventional ultrasound generator without nanostructures. The ultrasound generator according to the current exemplary embodiment includes a thermoelastic layer formed by depositing a 50 nm thick Au layer, and 2 μm thick parylene layer as a matching layer, and glass is used as a substrate. Nanopillars have a width, height, and interval which are each 100 nm. The conventional ultrasound generator has the same structure as the current exemplary embodiment except that the substrate and the thermoelastic layer are flat.

Referring to FIG. 3, a first curve C1 denotes a light absorption ratio of the ultrasound generator according to the current exemplary embodiment, and a second curve C2 denotes a light absorption ratio of the conventional ultrasound generator. A light absorption ratio of the ultrasound generator having nanostructures is larger than that of the conventional ultrasound generator. When a laser beam wavelength is 550 nm, a light absorption ratio of the conventional ultrasound generator is about 0.3, while that of the ultrasound generator according to the current exemplary embodiment is about 0.7. Thus, the light absorption ratio of the ultrasound generator according to the current exemplary embodiment is greater than that of the conventional ultrasound generator.

Therefore, the thermoelastic layer of the ultrasound generator of the current exemplary embodiment has an increased light absorption ratio due to a function of the nanopillars formed between the substrate and the thermoelastic layer. Furthermore, when the same laser energy is used in the ultrasound generator of the current exemplary embodiment and the conventional ultrasound generator, the ultrasound generator of the current exemplary embodiment generates an ultrasound having a pressure greater than that of an ultrasound generated by the conventional ultrasound generator.

FIGS. 4A through 4E are cross-sectional views illustrating a method of manufacturing an ultrasound generator according to exemplary embodiments.

Figure 4A:
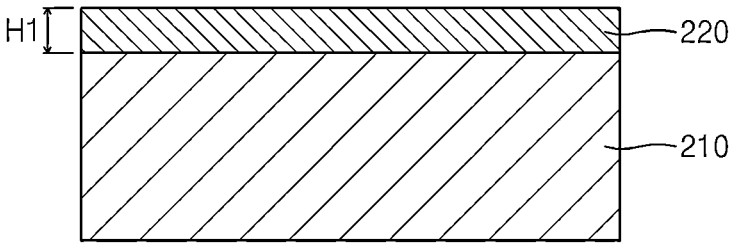
FIGS. 4A through 4E are cross-sectional views illustrating a method of manufacturing an ultrasound generator according to exemplary embodiments.

Referring to FIG. 4A, a metal layer 220 having a first thickness H1 is deposited on a substrate 210. The metal layer 220 may be formed of a typical metal such as Ag, Au or Pb. If a metal for the metal layer 220 has contracting properties upon being heated, then the metal for the metal layer 220 is not limited to a predetermined material as above. The first thickness H1 may be about 10 nm to about 1000 nm. The substrate 210 may be formed of, for example, quartz, fused silica or glass.

Figure 4B:
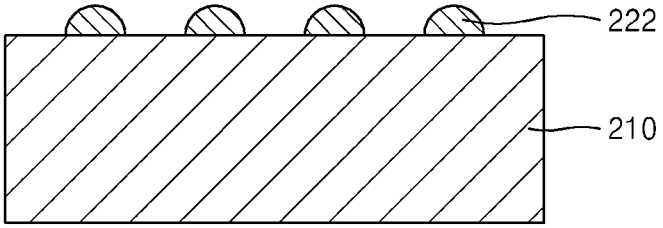

Referring to FIG. 4B, the substrate 210 is annealed. An annealing temperature may vary according to the material of the metal layer 220 and the first thickness H1. After the annealing, a plurality of metal dots 222 is formed on the substrate 210. Each of the metal dots 222 may have a size of about 10 nm to about 1000 nm, and a distance between the metal dots 222 may also be about 10 nm to about 1000 nm.

Figure 4C:
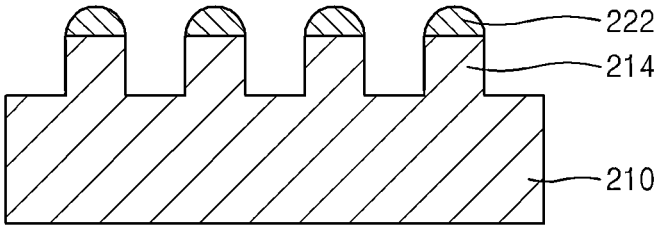

Referring to FIG. 4C, the metal dots 222 are used as a mask to dry-etch the substrate 210. After etching, a plurality of cylinder-shaped nanopillars 214 is formed on the substrate 210. An aspect ratio of the nanopillars 214 may be about 1. The nanopillars 214 may have a diameter of about 10 nm to about 1000 nm, and a gap between adjacent nanopillars 214 may be about 10 nm to about 1000 nm.

The substrate 210 is dipped into a solution which is capable of removing the metal dots 222, thereby removing the metal dots 222 from the substrate 210. FIG. 4C illustrates the substrate 210 before the metal dots 222 are removed.

Figure 4D:
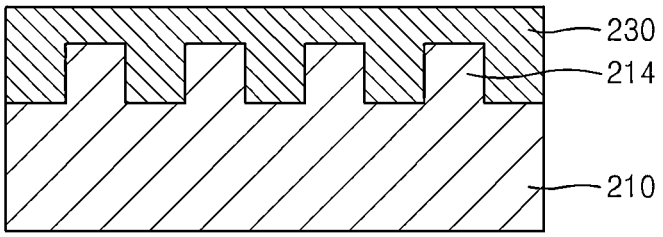

Referring to FIG. 4D, a thermoelastic layer 230 covering the nanopillars 214 is formed on the substrate 210. The thermoelastic layer 230 may be formed of a metal or a polymer material. For example, the thermoelastic layer 230 may be formed of a metal such as Cr, Ti, Au, or Al or of a polymer material such as black polydimethylsiloxane (PDMS) mixed with carbon or carbon tapes. If the thermoelastic layer 230 is formed of a metal, the thermoelastic layer 230 may be formed as a double layer. For example, the thermoelastic layer 230 may include an adhesive layer formed of Ti or Cr and a metal layer including Au or Al on the adhesive layer.

Figure 4E:
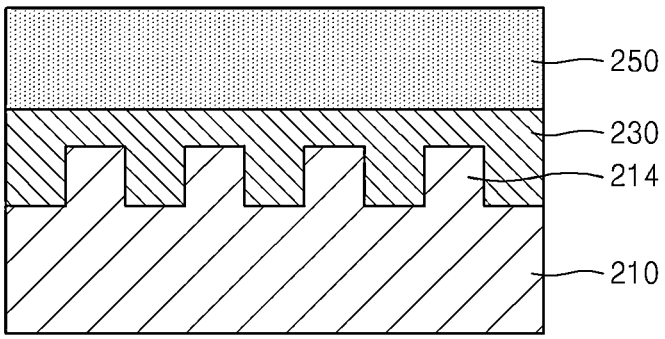

Referring to FIG. 4E, a matching layer 250 may be formed on the thermoelastic layer 230. The matching layer 250 may be formed of a polymer material. For example, the matching layer 250 may be formed of parylene, PMDS, or polyimide. The matching layer 250 may have a thickness of about several μm. The matching layer 250 may be formed of a plurality of layers. Also, the matching layer 250 may be formed of a plurality of layers that are formed of different materials.

When the thermoelastic layer 230 is formed of a polymer material, the matching layer 250 may be omitted.

According to the method of manufacturing a laser-induced ultrasound generator, as metal dots formed by annealing are used in forming nanopillars, an additional mask process involving a nano-sized mask is not required.

It should be understood that the exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope of the present disclosure as defined by the following claims.

What is claimed is:

1. A laser-induced ultrasound generator comprising:

a substrate comprising a plurality of nanostructures provided on a first surface of the substrate;

a thermoelastic layer provided on the first surface of the substrate, the thermoelastic layer being configured to generate an ultrasound by absorbing a laser beam incident onto a second surface of the substrate, the second surface facing the first surface; and a matching layer provided on the thermoelastic layer, wherein the matching layer is formed of different material from a material of the thermoelastic layer, and the matching layer faces the substrate with the thermoelastic layer therebetween, wherein the plurality of nanostructures is extended from the substrate as one body with the substrate, and a composition of the plurality of nanostructures is the same as a composition of the substrate.

2. The laser-induced ultrasound generator of claim 1, wherein the plurality of nanostructures comprise a plurality of cylinder-shaped nanopillars.

3. The laser-induced ultrasound generator of claim 2, wherein each of the plurality of nanopillars has a diameter of about 10 nm to about 1000 nm.

4. The laser-induced ultrasound generator of claim 3, wherein a gap between adjacent nanopillars is about 10 nm to about 1000 nm.

5. The laser-induced ultrasound generator of claim 1, wherein the thermoelastic layer comprises a metal or a polymer material.

6. The laser-induced ultrasound generator of claim 1, wherein the substrate comprises a laser beam-transmitting material.

7. The laser-induced ultrasound generator of claim 1, wherein the matching layer comprises a polymer.

8. The laser-induced ultrasound generator of claim 1, further comprising a laser oscillator configured to irradiate the laser beam onto the second surface of the substrate.

9. A method of manufacturing a laser-induced ultrasound generator, the method comprising:

forming a thin metal film on a substrate;

converting the thin metal film into a plurality of metal dots by annealing the substrate;

forming a plurality of nanostructures on the substrate by dry-etching the substrate, the dry-etching comprising using the plurality of metal dots as a mask;

removing the plurality of metal dots;

forming a thermoelastic layer on the substrate to cover the plurality of nanostructures; and forming a matching layer on the thermoelastic layer, the matching layer being formed of different material from a material of the thermoelastic layer, and the matching layer facing the substrate with the thermoelastic layer therebetween, wherein the forming of the plurality of nanostructures comprises forming the plurality of nanostructures to extend from the substrate as one body with the substrate, a composition of the plurality of nanostructures being the same as a composition of the substrate.

10. The method of claim 9, wherein the substrate comprises a laser beam-transmitting material.

11. The method of claim 9, wherein the forming of the thin metal film comprises forming a thin metal film having a thickness of about 10 nm to about 1000 nm.

12. The method of claim 9, wherein the converting of the thin metal film into the plurality of metal dots comprises forming metal dots, each having a diameter of about 10 nm to about 1000 nm, as the plurality of metal dots.

13. The method of claim 12, wherein the forming of the plurality of nanostructures comprises forming a plurality of nanopillars, each having a diameter corresponding to a size of one of the plurality of metal dots, as the plurality of nanostructures.

14. The method of claim 9, wherein the forming of the thermoelastic layer comprises forming the thermoelastic layer out of a metal or a polymer.

15. The method of claim 9, wherein the forming of the matching layer comprises forming the matching layer out of a polymer.

* * * * *